United States Patent [19]

Revett

[11] 4,444,050

[45] Apr. 24, 1984

[54] FREEPOINT INDICATOR

[75] Inventor: Lowell W. Revett, Youngsville, La.

[73] Assignee: Halliburton Company, Duncan, Okla.

[21] Appl. No.: 322,487

[22] Filed: Nov. 18, 1981

[51] Int. Cl.[3] ..... E01B 47/09

[52] U.S. Cl. ..... 73/151

[58] Field of Search ..... 73/151; 166/255

[56] References Cited

U.S. PATENT DOCUMENTS

| | | | |
|---|---|---|---|
| 2,716,890 | 9/1955 | Martin | 73/151 |
| 3,585,857 | 6/1971 | Moore | 73/151 |
| 4,207,765 | 6/1980 | Kiff | 73/151 |
| 4,351,186 | 9/1982 | Moulin | 73/151 |

*Primary Examiner*—Anthony V. Ciarlante

*Attorney, Agent, or Firm*—W. J. Beard

[57] ABSTRACT

A system and apparatus for determining the free point location in a well bore upon determinable criteria. The free point tool, is disposed in a stuck point and actuated at a plurality of locations along the length of the string of pipe. At each location, the free point indicator is fixed in position and the string of pipe is subjected to a motivating force which produces either an elongation of the pipe string or a twisting of the pipe string. The elongation or the twisting is recorded at the surface as a function of time. The downhole indication of elongation or twisting at the location of the free point indicator is also recorded as a function of time. The time delay and the character of the elongation or twisting is indication of the character of the sticking of the pipe.

4 Claims, 3 Drawing Figures

FREEPOINT INDICATOR

THE PRESENT INVENTION

The present invention relates to free point indicators, or more particularly devices for locating the point in a well bore at which a pipe in the well bore is free of a constraining influence in the well bore.

The prior art contains a number of devices for free point indicators such as the devices disclosed in U.S. Pat. Nos. 3,942,373; 2,814,019; 2,817,808; and 3,762,218. The term "free point" is commonly used to refer to the location at which a pipe or tubing is stuck in a well bore. The pipe is considered stuck when it can not be raised or rotated relative to the well bore. The term "stuck point" indicator is also used to define the same type of problem. Thus, for all practical purposes, "free point" and "stuck point" are comparable to the definition of a water glass is either half full of water or half empty of water. In any event, the object of free point indicator systems is to locate the depth location in a well bore where a pipe has become stuck.

The pipe in a well bore can become stuck during a drilling operation or other operations for a number and variety of reasons too common to define, although a principal reason is a cave-in of the wall of a well bore on the pipe. When the pipe becomes stuck in the well bore, the operation to unstick the pipe involves first locating the point of fixation in the well bore. When the stuck point is located, the pipe can be cut off or backed off (unscrewed) just above the stuck point and thereafter, the stuck pipe retrieved through conventional fishing operations.

The casing or tubing in a producing well can also become stuck, and the present invention is applicable to locating the stuck point.

Heretofore, the location of the free point in a stuck pipe situation has been based on the experience of the operator to interpret the response of the indicator tool in the well pipe. Thus, the location of free point at present is principally based the upon instincts, experience, or a combination of both in the operator. The determination of free point by instinct lacks the preciseness and reliability which ordinarily characterizes most oil field down hole operations and no record is made of the operation.

SUMMARY OF THE PRESENT INVENTION

Briefly, the present invention provides a new and improved system and apparatus for determining the free point location in a well bore upon determinable criteria or parameters. In the present invention, the free point tool is disposed in a stuck pipe and actuated at a plurality of locations along the length of the string of pipe. At each location, the free point indicator tool is fixed in position upon actuation and the string of pipe is subjected to a motivating force which produces either an elongation of the pipe string or a twisting of the pipe string. The elongation or the twisting is recorded at the surface as a function of time. The downhole indication of elongation or twisting at the location of the free point indicator tool is also recorded as a function of time. The time delay and the character of the elongation or twisting is indicative of the character of the sticking of the pipe. The apparatus of the invention is the organization of instruments to obtain comparative measurements from which a quantative result can be determined. It also provides a permanent record of free point operations which has not before been available.

DESCRIPTION OF THE PREFERRED EMBODIMENT

Figure 1:
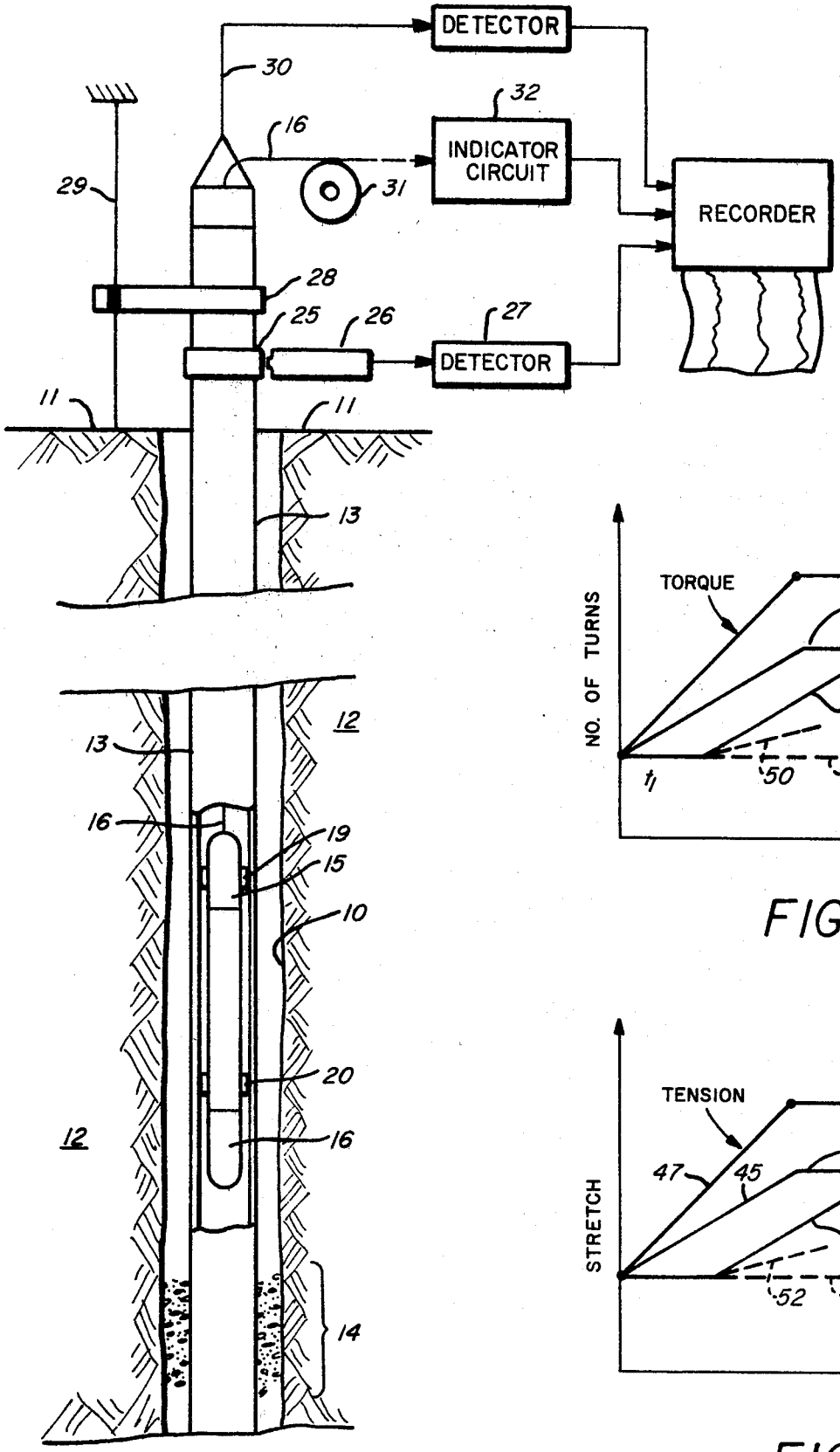
FIG. 1 is a view through a cross-section of a well bore and illustrating apparatus for performing the present invention.

Referring now to FIG. 1, a well bore 10 extends from the earth's surface 11 through various earth formations 12. A drilling pipe 13 is shown disposed in the well bore 10 with an interval 14 of the well bore in which the pipe 13 is lodged or fixed in position and has become immovable. A free point indicator tool 15 is shown disposed at a location above the stuck point in the well bore and is transported through the pipe by means of an electrical armored cable 16. The free-point tool 15 can carry with it a back off tool 16 for severing the pipe above a stuck point.

The free point tool 15 is adapted upon actuation in the well bore to become anchored at locations 19 and 20 so that the application of stress to the pipe, whether torque or tension, will move the anchor locations 19 and 20 relative to one another and the tool will produce an electrical signal indicative of the relative movement of the pipe section between the anchor locations 19 and 20.

At the earth's surface, the string of pipe has attached thereto a magnetic collar 25 which has radially magnetized teeth members which cooperate with a detecting magnet means 26 to produce an indication of rotative displacement of the pipe in a detector 27. Thus, surface rotation of the pipe by a pipe torque means can be detected by the detector 27. The detector 27 could also be mechanical or electrical (photoelectric) in nature as well as the magnetic detector described herein.

Also attached to the string of pipe is a detecting collar means 28 which provides a reference indication with respect to a vertical wire with magnet marks for indicating vertical displacement of the pipe 13 with respect to a fixed point on the upper earth surface 11. The collar 28 is also provided with rotative bearings to maintain its position location when the pipe is rotated. The pipe is adapted to be placed in tension by a tensioning device 30 which produces a longitudinal stress or stretch in the pipe.

The cable 16 for the free point tool 15 is spooled upon a winch 31 and electrically coupled to an indicator circuit 32. The indicator circuit 32 provides electrical signals representative of longitudinal stress in the pipe. The output of the indicator circuit 32 and the output of the detectors 27 are input into a surface recorder to recod, as a function of time, elongation and rotation or torque and the down hole indication of elongation and rotation.

In the practice of the present invention, the free point indicator tool 15 should be capable of measuring both torque deflection and stretch deflection. The deflection measurements in the free point tool 15 should be capable of transmission through the wire line cable 16 to the surface indicator 31 where the indication of deflection stretch or torque may be recorded as a function of time. The recorder in the present invention preferably should be adapted to produce a record as a function of time, of the measured downhole parameters of rotative deflection, surface rotation and surface torque as comparison curves, and the downhole stretch or deflection parameter, surface tension force and surface elongation as a second set of comparison curves.

Figure 2A:
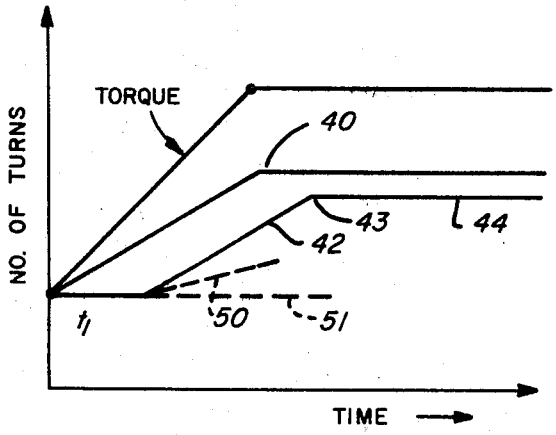
FIGS. 2(A) and 2(B) are respectively plots of turns and torque versus time and stretch and tension versus time.
Figure 2B:
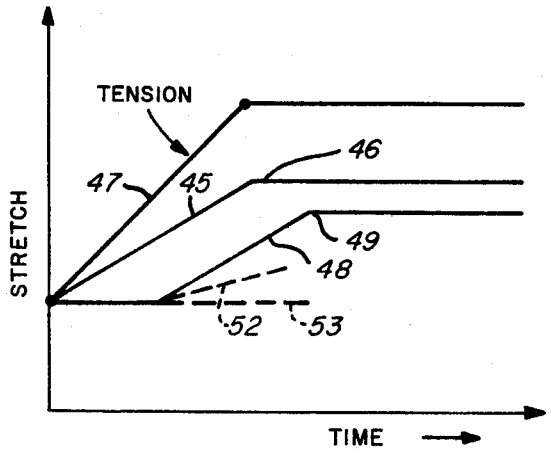

As shown in FIG. 2, if a rotative torque force is applied to the drill pipe at the earth's surface to rotate or twist the pipe string at the earths' surface by a predetermined number of turns, then the force can be held constant at the pre-determined number of turns as indicated by the line 41. The number of rotations as shown by the curve is represented as a function of time. The downhole free point indicator 15 at a given location will, after a time delay, have a gradually increasing rotative deflection as indicated by the slope of the line 42 to a point 43. On the time scale, the deflection curve 42 is displaced due to a time delay. The rotative deflection should be relatively constant as shown by the line 44 after the torque is held constant.

After producing the first recorded measurements of torque or rotation as a function of time, a second test is run at the same location except that the pipe is stretched by the application of a predetermined tension force. The slope of the curve 45 indicates the stretch of the pipe in terms of movement to a maximum pre-determined tension at the point 46, whereupon the tension force is held constant. The amount of surface deflection as a function of time is shown by the curve 47 and the downhole deflection from the downhole free point indicator as a function of time will produce a curve such as shown by line 48 to the point 49 after a delay.

The series of steps is repeated along the length of pipe until the stuck point is located. When the tool is disposed below the stuck point the pipe turns will not be imparted to the pipe below where it is fixed. However, the pipe can be fixed against longitudinal motion but not confined against rotative motion. Thus, as shown by curves 50 and 51, the curves indicate the differences between a partially stuck and fully stuck location. Similarly, in FIG. 2, the curves 52 and 53 indicate the differences between a partially stuck and fully stuck location. At the location where the stuck point is located, the tool is raised to a point just above the stuck point and the pipe is severed.

Thus, for a given depth, the tool measurements of stretch and tension are recorded on a recording apparatus as a function of time, giving a correlatable relationship between the deflection and torque and the torque applied at the surface. The recording process is repeated for each level of tests until the response of a deflection curve does not track the surface applied deflection. At such time as the downhole deflection deviates from a normal incremental response, the deviation can be interpreted in terms of the pipe response at the measurement location. The location where no response measurement is obtained is below the true fixed point of the pipe. Thus, the present invention permits precise visual analysis and location of the stretch point. While I have discussed use of both stretch and torque measurements because they represent different types of stretching, both measurements need not be used contemporaneously.

I claim:

1. A method in analyzing the nature of deflection of a string of pipe in a well bore between a surface location and a stuck point in a well bore comprising the steps of:

sequentially locating a free point indicator means at a series of locations along a pipe string in a well bore;

at each of such locations temporarily attaching the free point indicator means relative to the string of pipe and, while said free point indicator means is temporarily attached to said string of pipe, applying a deflection force to the string of pipe at the earth's surface;

measuring the deflection of the string of pipe at the earth's surface;

measuring the deflection of the string of pipe at the location of the stretch point indicator means;

recording each of said measurements as a function of time.

2. The method as set forth in claim 1 wherein the deflection force applied includes applying tension to the string of pipe and, at the same location, applying torque to the string of pipe.

3. The method as set forth in claim 1 wherein the amount of force applied to produce the deflection is recorded.

4. The method as set forth in claim 2 wherein, at the location of the stuck point, the further step of severing the pipe above the stuck point.

* * * * *